US006820450B2

(12) United States Patent
Yamada et al.

(10) Patent No.: US 6,820,450 B2
(45) Date of Patent: Nov. 23, 2004

(54) BENDING DEVICE

(75) Inventors: Takayuki Yamada, Seto (JP); Teruaki Yogo, Seto (JP)

(73) Assignee: Kabushiki Kaisha Opton, Seto (JP)

( * ) Notice: Subject to any disclaimer, the term of this patent is extended or adjusted under 35 U.S.C. 154(b) by 166 days.

(21) Appl. No.: 10/153,194

(22) Filed: May 21, 2002

(65) Prior Publication Data

US 2002/0174703 A1 Nov. 28, 2002

(30) Foreign Application Priority Data

May 23, 2001 (JP) ..... 2001-153946

(51) Int. Cl.[7] ..... B21D 7/04; B21B 37/12

(52) U.S. Cl. ..... 72/151; 72/149; 72/152; 72/453.02

(58) Field of Search ..... 72/151, 152, 149, 72/453.02

(56) References Cited

U.S. PATENT DOCUMENTS 4,269,054 A * 5/1981 Eaton ..... 72/151
5,259,224 A * 11/1993 Schwarze ..... 72/149
5,379,624 A * 1/1995 Harman et al. ..... 72/149
5,819,574 A * 10/1998 Yogo ..... 72/149
5,862,697 A * 1/1999 Webster ..... 72/149
6,644,079 B2 * 11/2003 Harman et al. ..... 72/149

FOREIGN PATENT DOCUMENTS

| | | |
|---|---|---|
| DE | 2 044 136 | 3/1972 |
| DE | 2 257 368 | 6/1974 |
| DE | 296 20 391 U1 | 3/1997 |
| DE | 197 51 504 A1 | 7/1998 |
| EP | 0 811 437 A1 | 6/1997 |
| JP | 2-274321 | 11/1990 |

* cited by examiner

*Primary Examiner*—David Jones
(74) *Attorney, Agent, or Firm*—Davis & Bujold, P.L.L.C.

(57) ABSTRACT

The bending device comprises a hydraulic motor for moving a feeding table, and a hydraulic circuit including first and second switching valves which can be selectively switched between a speed control channel for supplying operating oil from a discharge-rate variable hydraulic pump to the hydraulic motor by way of a servo valve and a pressure control channel for supplying high pressure operating oil from the hydraulic pump to the hydraulic motor. When the feeding table provided with a chuck mechanism gripping a longitudinal material is moved to a bending mechanism to bend the material, control of the speed and application of axial compressive force can be conducted by switching of the first and second switching valves.

6 Claims, 7 Drawing Sheets

BENDING DEVICE

FIELD OF THE INVENTION

This invention relates to a bending device, which can both control a feeding speed of a longitudinal material and apply an axial compressive force to the material.

BACKGROUND OF THE INVENTION

As disclosed in the Unexamined Japanese Patent Publication No. 2-274321, when feeding a longitudinal material through a bending mechanism at a high speed, a known conventional device engages a first clutch to transmit rotation of a motor to a drive shaft by way of a first transmission mechanism and then moves a feeding table toward the bending mechanism by means of the drive shaft to feed the material.

During bending, which requires a compressive force along the axis of the material, the device selects and engages a second clutch. This second clutch transmit rotational of the motor to 1) the drive shaft by way of a second transmission mechanism at a moderating ratio larger than that of the first transmission mechanism, and 2) moves the feeding table by driving the drive shaft with a large driving force to generate an axial compressive force in the material.

However, such conventional devices require a plurality of clutches and a plurality of these devices requires an unnecessarily large amount of space.

SUMMARY OF THE INVENTION

An object of the present invention is to provide a bending device which is small in size but able to feed a material at a high speed. Another object of the present invention is to provide a bending device which applies an axial compressive force to the material.

To attain this and other objects, the present invention provides a bending device for moving a feeding table. The bending device is equipped with a chuck mechanism for gripping a longitudinal material, and a bending mechanism to bend the material therein.

The bending device comprises a hydraulic actuator for moving the feeding table, and a hydraulic circuit. The hydraulic circuit can be selectively switched between a speed control channel and a pressure control channel. The speed control channel for supplies operating oil from a hydraulic source to the hydraulic actuator by controlling the speed of the operating oil. The pressure control channel supplying operating oil from the hydraulic source to the hydraulic actuator by controlling the pressure of the operating oil.

A hydraulic pump which can vary its discharge rate may be used for the hydraulic source and a hydraulic motor may be used for the hydraulic actuator. A servo valve may be provided in the speed control channel. A pressure reducing valve may be provided in the pressure control channel.

BRIEF DESCRIPTION OF THE DRAWING

The invention will now be described, by way of example, with reference to the accompanying drawings, in which.

DETAILED DESCRIPTION OF THE INVENTION

Figure 1:
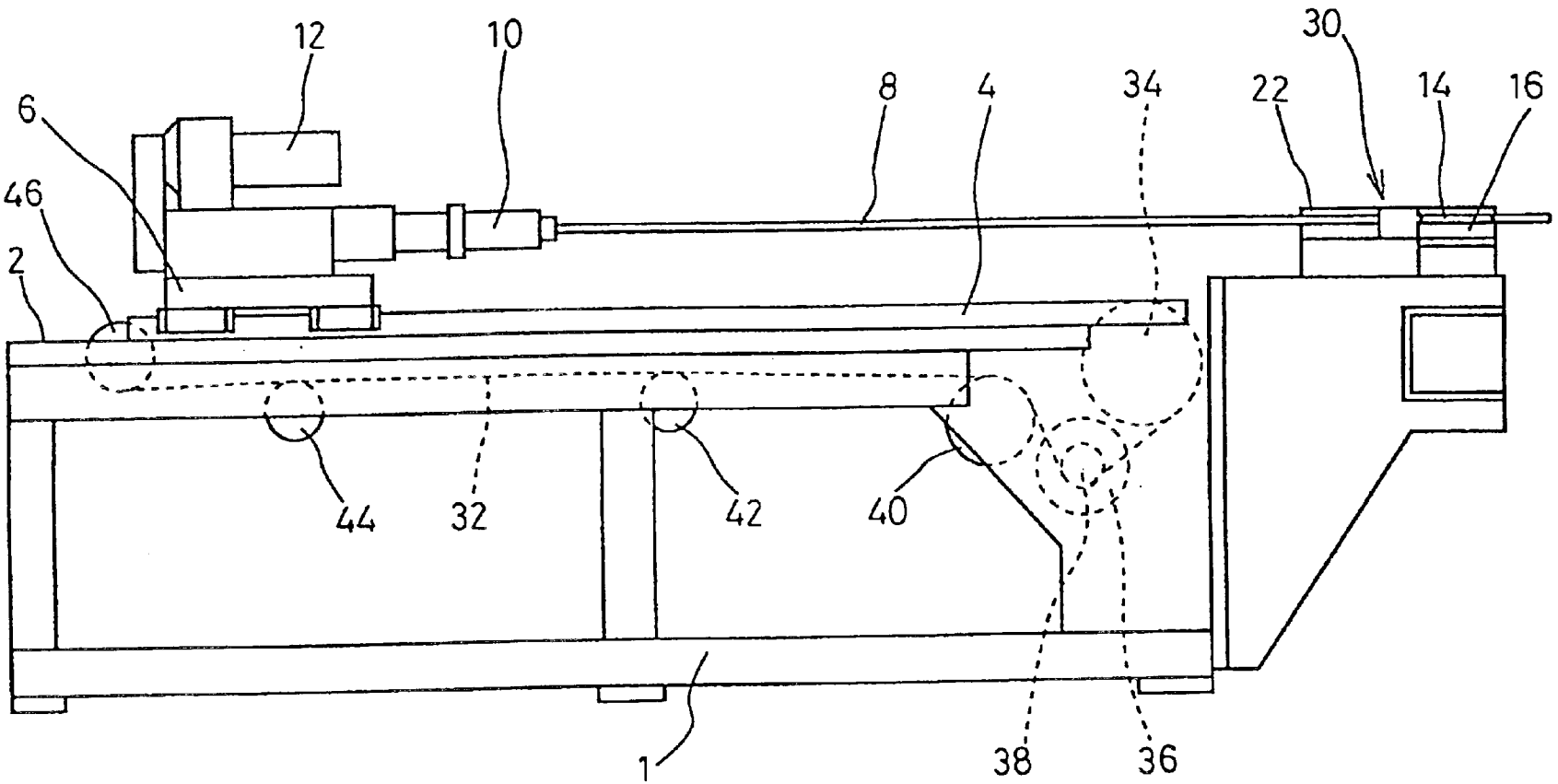
FIG. 1 is an elevation view of a bending device according to an embodiment of the present invention.

As shown in FIG. 1, two rails 4 (only one of them is shown in the figure) are laid on a top surface 2 of a device body 1. Between these two rails 4 extends a feeding table 6 which is supported therebetween in a movable manner.

A chuck mechanism 10 for gripping an end of a longitudinal material 8 (e.g. pipe) is mounted on the feeding table 6. This chuck mechanism 10 is driven by a motor 12 and, while gripping the material 8, rotates around the axis of the material 8. It is thus possible to rotate the material 8 and bend the same in three dimensions.

A bending die 16 is arranged on an extended portion of the rails 4 at the front end of the device body 1, a bending die 16 is arranged. The bending die 16 is formed in accordance with a bending radius, and comprises a groove 14 having a diameter in accordance with that of the material 8. A clamping die 18 is provided opposite to the bending die 16. The clamping die 18 is operated by a hydraulic cylinder 20 to move toward the bending die 16 and simultaneously hold the material 8 and the bending die 16.

A pressure die 22 is also provided adjacent to the clamping die 18. This pressure die 22 is operated by a hydraulic cylinder 24 to move and thrust itself against the material 8. This pressure die 22 is also operated by a hydraulic cylinder 26 to move along in the axial direction of the material 8. A wiper die 28 is arranged on the material 8 opposite to the pressure die 22.

After the clamping die 18, is driven by the hydraulic cylinder 20, clamps together the material 8 with the bending die 16, the bending die 16 rotates on the axis and the clamping die 18 rotates around the bending die 16. The bending die 16 is driven by a hydraulic cylinder (not shown). Thereby, it is possible to bend the material 8 to a predetermined radius. In the present embodiment, the bending die 16, clamping die 18, pressure die 22, wiper die 28, hydraulic cylinders 20, 24 and 26 constitutes a bending mechanism 30.

One end of a chain 32 is joined to a front end of the feeding table 6, and the other end of the chain 32 is joined to a rear end of the feeding table 6. The chain 32 is provided on the front end of the rails 4, and bridges sprockets 34, 38, 40, 42, 44 and 46. The sprockets 34, 40, 42 and 44 are respectively supported by the device body 1 in a rotatable manner, and the sprocket 38 is attached to a rotating shaft of the hydraulic motor 36, which is mounted on the device body 1 as a hydraulic actuator. The sprocket 46 is supported at a rear end of the rails 4 in a rotatable manner.

Figure 3:
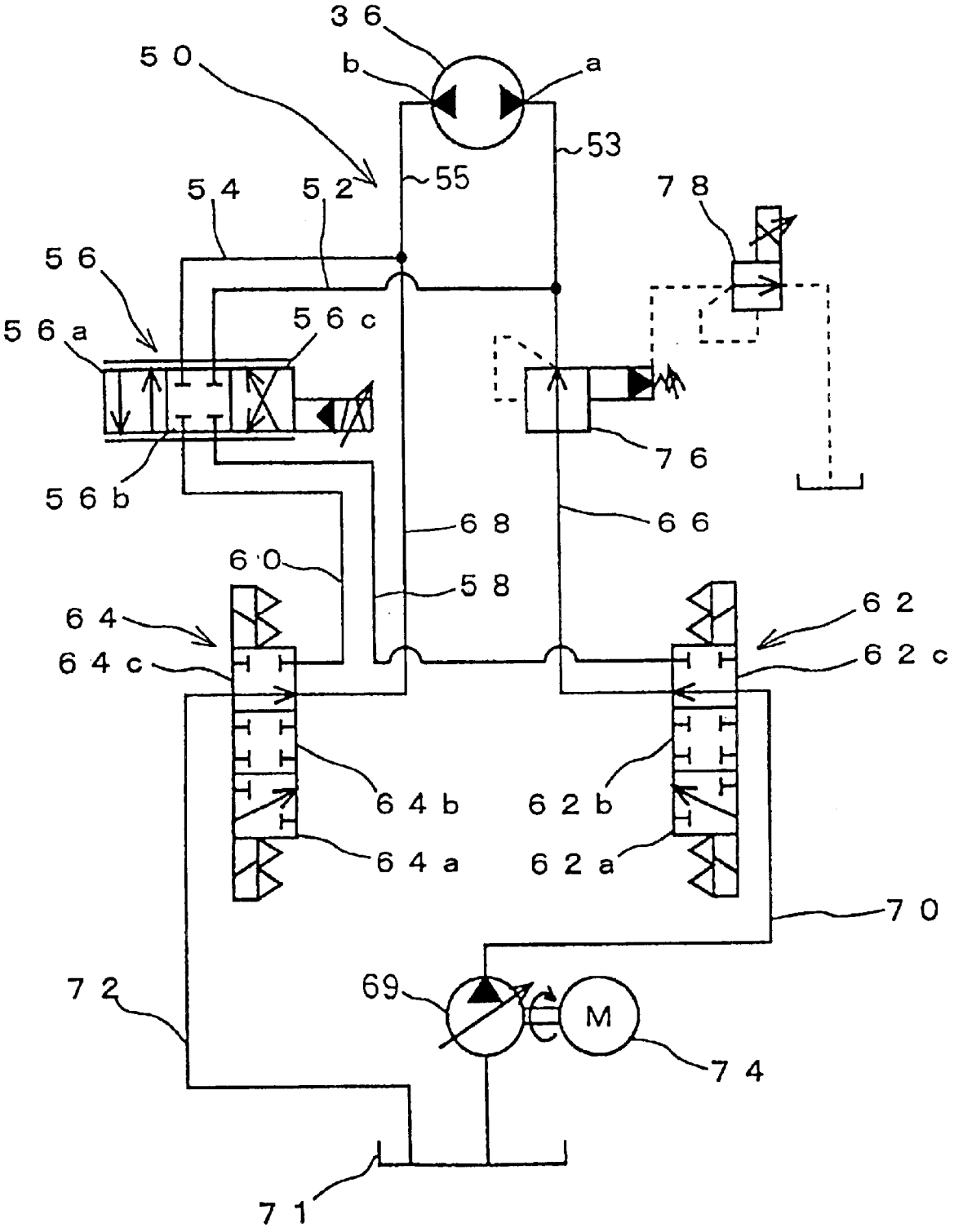
FIG. 3 is a hydraulic circuit diagram of the embodiment.

FIG. 3 shows a hydraulic circuit 50 for supplying operating oil to the hydraulic motor 36. First and second speed control channels 52 and 54 are connected to first and second supply/discharge channels 53 and 55, and the first and second supply/discharge channels 53 and 55 are respectively connected to supply/discharge ports "a" and "b" of the hydraulic motor 36. The first and second speed control channels 52 and 54 are also connected to a servo valve 56.

The servo valve 56 can be switched to three positions. At a normal rotation position 56*a*, the first speed control channel 52 communicates with a third speed control channel 58 and the second speed control channel 54 communicates with a fourth speed control channel 60. At a stop position 56*b*, all the channels are cut off. At a back rotation position 56*c*, the first speed control channel 52 communicates with the fourth speed control channel 60 and the second speed control channel 54 communicates with the third speed control channel 58. Additionally, the servo valve 56 can continuously vary flow volume, that is, a speed of supplying the operating oil to the hydraulic motor 36, in proportion to an inputted exciting current while being switched between the positions 56*a*–56*c*.

The third speed control channel 58 is connected to a first switching valve 62, and the fourth speed control channel 60 is connected to a second switching valve 64. The first switching valve 62 is connected to the first supply/discharge channel 53 by way of a first pressure control channel 66, and the second switching valve 64 is connected to the second supply/discharge channel 55 by way of a second pressure control channel 68.

A supply channel 70 is connected to the first switching valve 62 and to a hydraulic pump 69 which serves as a hydraulic source. A return channel 72 is connected to the second switching valve 64 and communicates with a hydraulic tank 71. The hydraulic pump 69 is driven by an electric motor 74 and can vary its discharge rate in proportion to the inputted exciting current.

The first switching valve 62 can be switched to three positions according to an inputted exciting signal. At a speed control position 62*a*, the third speed control channel 58 communicates with the supply channel 70. At a stop position 62*b*, all the channels are cut off. At a pressure control position 62*c*, the first pressure control channel 66 communicates with the supply channel 70.

The second switching valve 64 can also be switched to three positions according to the inputted exciting signal. At a speed control position 64*a*, the fourth speed control channel 60 communicates with the return channel 72. At a stop position 64*b*, all the channels are cut off. At a pressure control position 64*c*, the second pressure control channel 68 communicates with the return channel 72.

An electromagnetic proportional pressure reducing valve is arranged in the first pressure control channel 66. The electromagnetic proportional pressure reducing valve comprises a pressure reducing valve 76 provided in the first pressure control channel 66 and an operate valve 78. The pressure reducing valve 76 reduces pilot pressure to control the pressure in the first pressure control channel 66. The pilot pressure is controlled in proportion to the exciting current by the operate valve 78.

Figure 4:
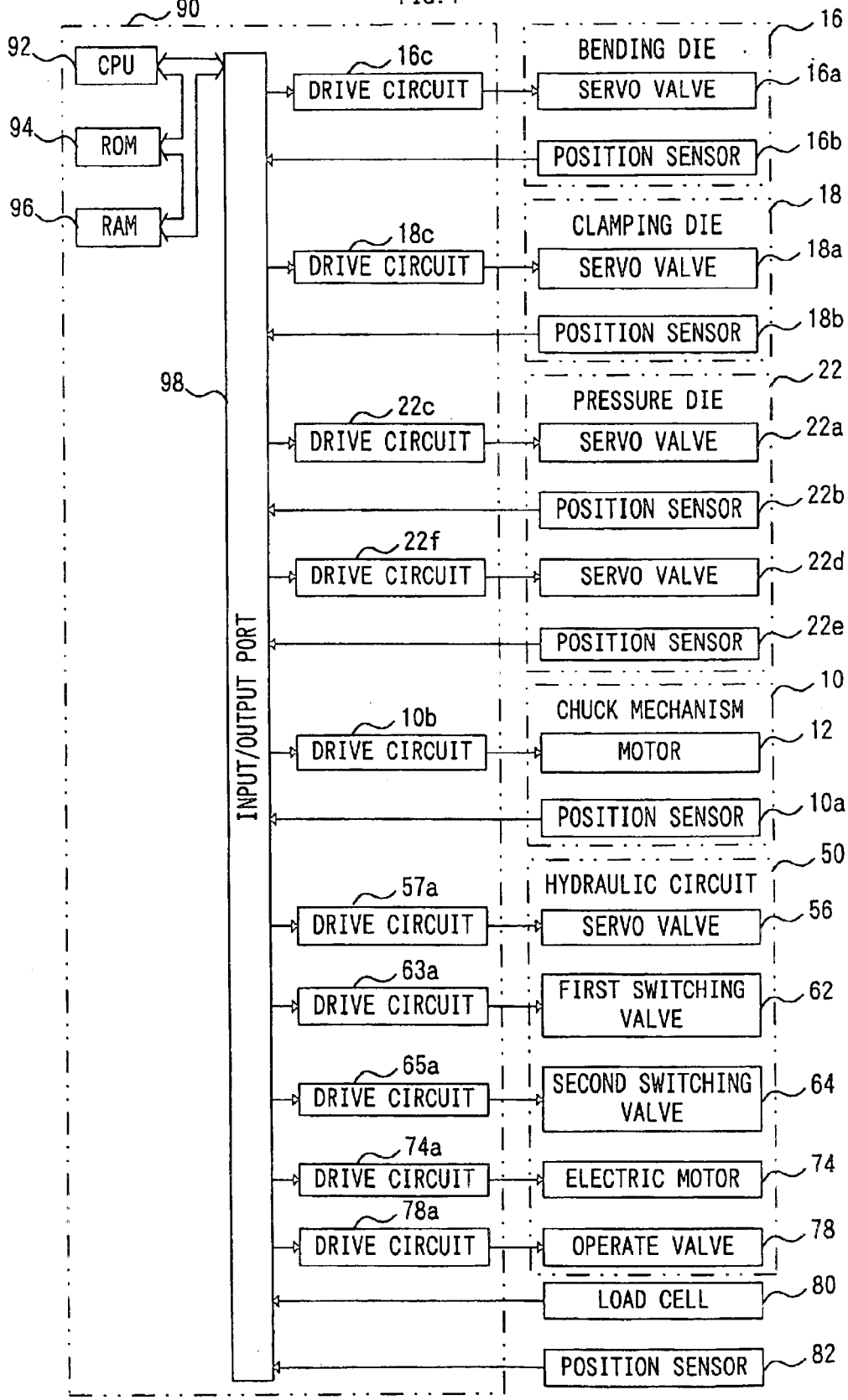
FIG. 4 is a block diagram illustrating a configuration of an electric system of the embodiment.

FIG. 4 is a block diagram showing an electric system of the bending device of the present embodiment. The device is driven and controlled by an electronic control circuit 90 to process the material 8. This electronic control circuit 90 is mainly constituted of a known logic circuit comprising CPU 92, ROM 94 and RAM 96. The logic circuit is connected to an external servo valve and so on via an input/output port 98 for signal input/output.

Signals are inputted to the CPU 92 via the input/output port 98 from respective position sensors 16*b*, 18*b*, 22*b*, 22*e*, 10*a* and 82 and from a load cell 80.

Among the aforementioned sensors, the position sensor 16*b* includes an encoder for detecting a rotation angle position of the bending die 16. The position sensor 18*b* includes a limit switch for detecting forward and backward ends of the clamping die 18. The position sensor 22*b* includes a limit switch for detecting forward and backward ends of the pressure die 22, and the position sensor 22*e* includes a limit switch for detecting forward and backward ends of the pressure die 22 in the axial direction of the material 8. The position sensor 10*a* includes an encoder for detecting a rotation angle position of the chuck mechanism 10 by detecting rotation of the motor 12. The position sensor 82 includes an encoder for detecting a position of the feeding table 6 by detecting rotation of the hydraulic motor 36.

In order to detect axial compressive force (pressure) applied to the material 8, a load cell provided in the feeding table 6 or in the chain 32, or on the chuck mechanism 10.

The CPU 92 outputs control signals via the input/output port 98 and drive circuits 16*c*, 18*c*, 22*c*, 22*f*, 10*b*, 57*a*, 63*a*, 65*a*, 74*a* and 78*a*, on the basis of data and signals from the sensors and load cell as well as from data stored in the ROM 94 and the RAM 96, to control each drive system in the bending device.

In FIG. 4, a servo valve 16*a* operates a hydraulic cylinder to rotate the bending die 16 as well as to rotate the clamping die 18 around the bending die 16. A servo valve 18*a* operates the hydraulic cylinder 20 to drive the clamping die 18. Servo valves 22*a* and 22*d* operate the hydraulic cylinders 24 and 26, respectively, in order to drive the pressure die 22.

Figure 5A:
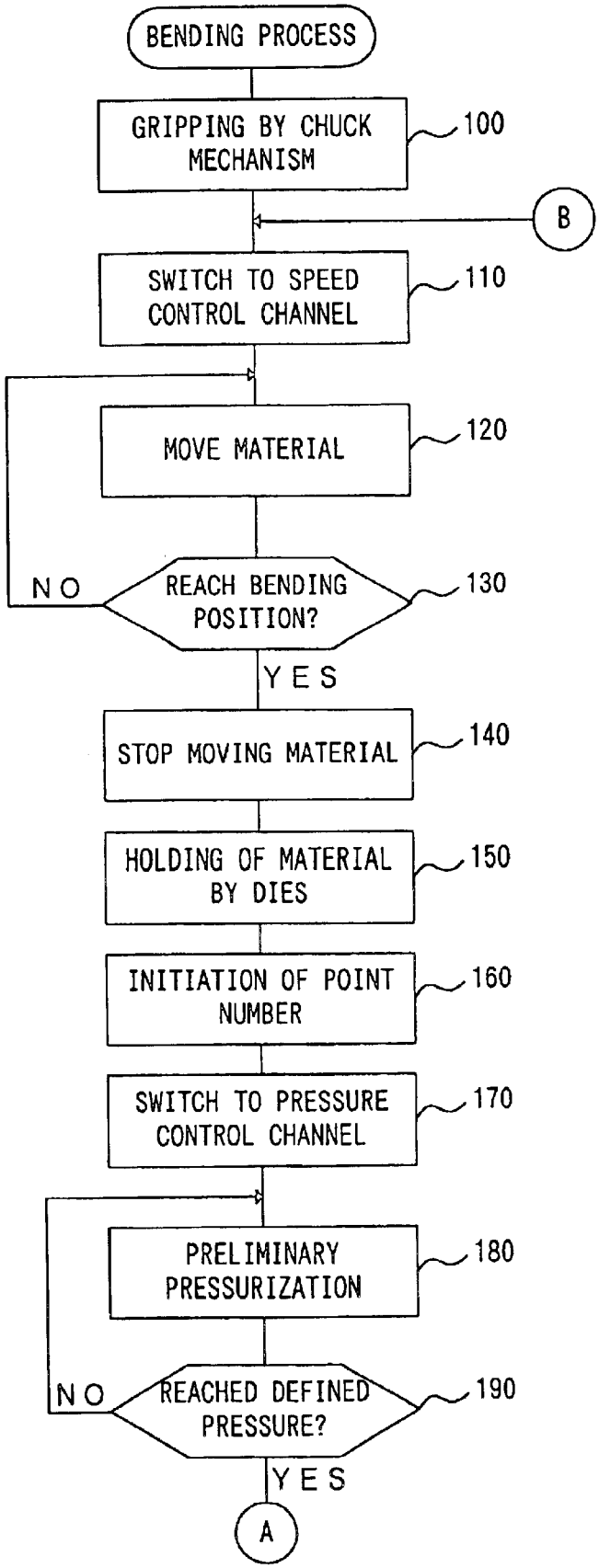
FIGS. 5A and 5B are a flowchart illustrating an example of a control process performed in an electric control circuit of the embodiment.
Figure 5B:
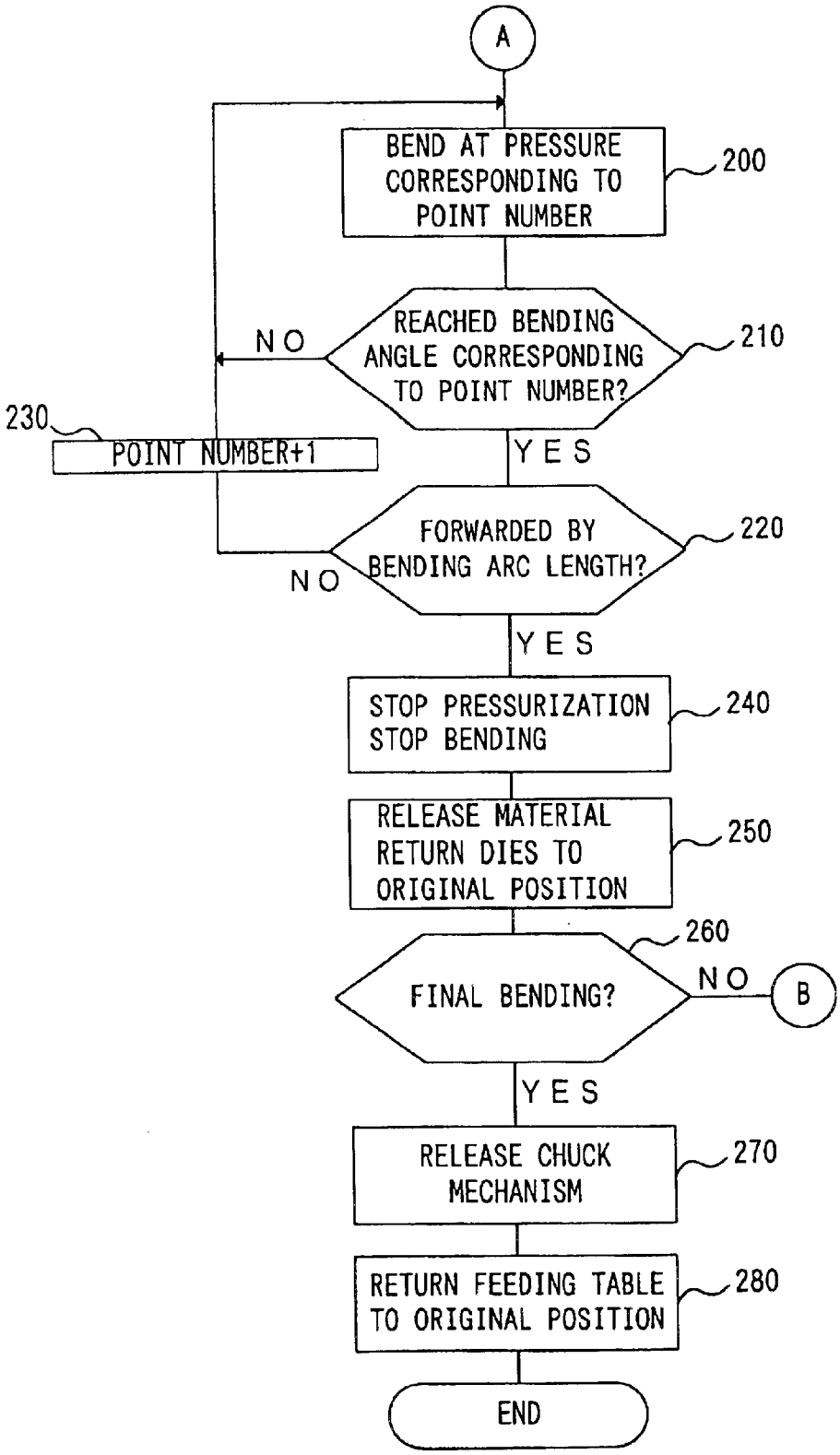
Figure 6:
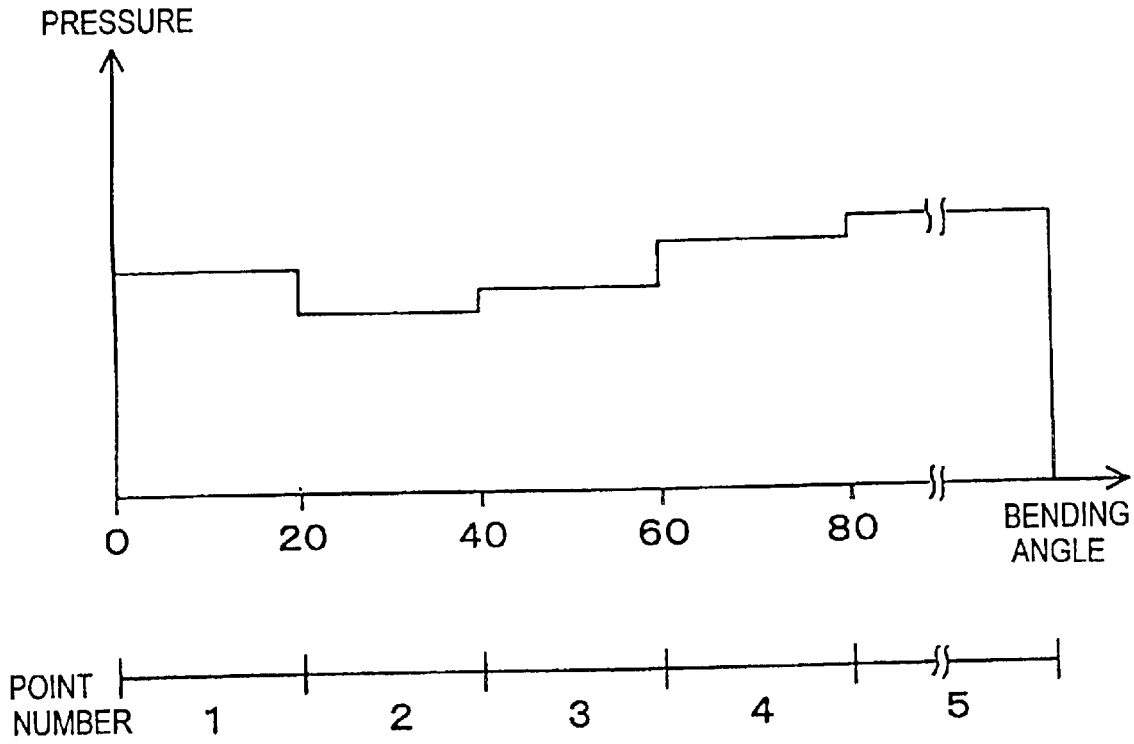
FIG. 6 is an explanatory view showing a change of axial compressive force (pressure) applied to a material to be bent in the bending device of the embodiment.

A process performed in the electronic control circuit 90, for bending material 8 in the bending device of the present embodiment is described by way of a flowchart illustrated in FIGS. 5A and 5B and an explanatory view in FIG. 6.

Firstly, a rear end of the material 8 is gripped by the chuck mechanism 10 (Step 100). Before the material 8 being fed to the bending mechanism 30, each valve in the hydraulic circuit 50 is set at a speed control channel position (Step 110). More particularly, the first switching valve 62 is switched to the speed control position 62*a* in accordance with a drive signal outputted via the drive circuit 63*a*. The second switching valve 64 is also switched to the speed control position 64*a* in accordance with a drive signal outputted via the drive circuit 65*a*. Moreover, the servo valve 56 is switched to the normal rotation position 56*a* in accordance with a drive signal outputted via the drive circuit 57*a*.

A drive signal is outputted via the drive circuit 74*a* to the electric motor 74. The electric motor 74 drives the hydraulic pump 69. The feeding table 6 is moved to the bending mechanism 30 to feed the material 8 (Step 120).

At this point, operating oil discharged from the hydraulic pump 69 is supplied to the hydraulic motor 36 from the supply/discharge port a via the supply channel 70, the first switching channel 62, the third speed control channel 58, the servo valve 56, the first speed control channel 52 and the first supply/discharge channel 53. Operating oil discharged from the supply/discharge port b of the hydraulic motor 36 is returned to the hydraulic tank 71 via the second supply/discharge channel 55, the second speed control channel 54, the servo valve 56, the fourth speed control channel 60, the second switching valve 64 and the return channel 72.

In Step 120, during the flow of the operating oil, the exciting current supplied to the servo valve 56 via the drive circuit 57*a* is controlled to adjust the volume of the operating oil supplied to the hydraulic motor 36, which thus spins at a rotational frequency proportional to the exciting current.

In other words, if a fluid path including the speed control channels 52, 54, 58 and 60 where the servo valve 56 is arranged, is used for passing of the operating oil, the opening area of the servo valve 56 can be adjusted by controlling the exciting current supplied to the servo valve 56, and it is possible to spin the hydraulic motor 36 at a speed corresponding to the valve-opening area.

Then, the feeding table 6 moves toward the bending mechanism 30 by way of the sprocket 38 and the chain 32 at a speed corresponding to the spinning speed of the hydraulic motor 36. On the other hand, the discharge rate from the hydraulic pump 69 is increased according to the drive signal outputted to the electric motor 74 via the drive circuit 74*a*, in order to build up enough speed.

Figure 2:
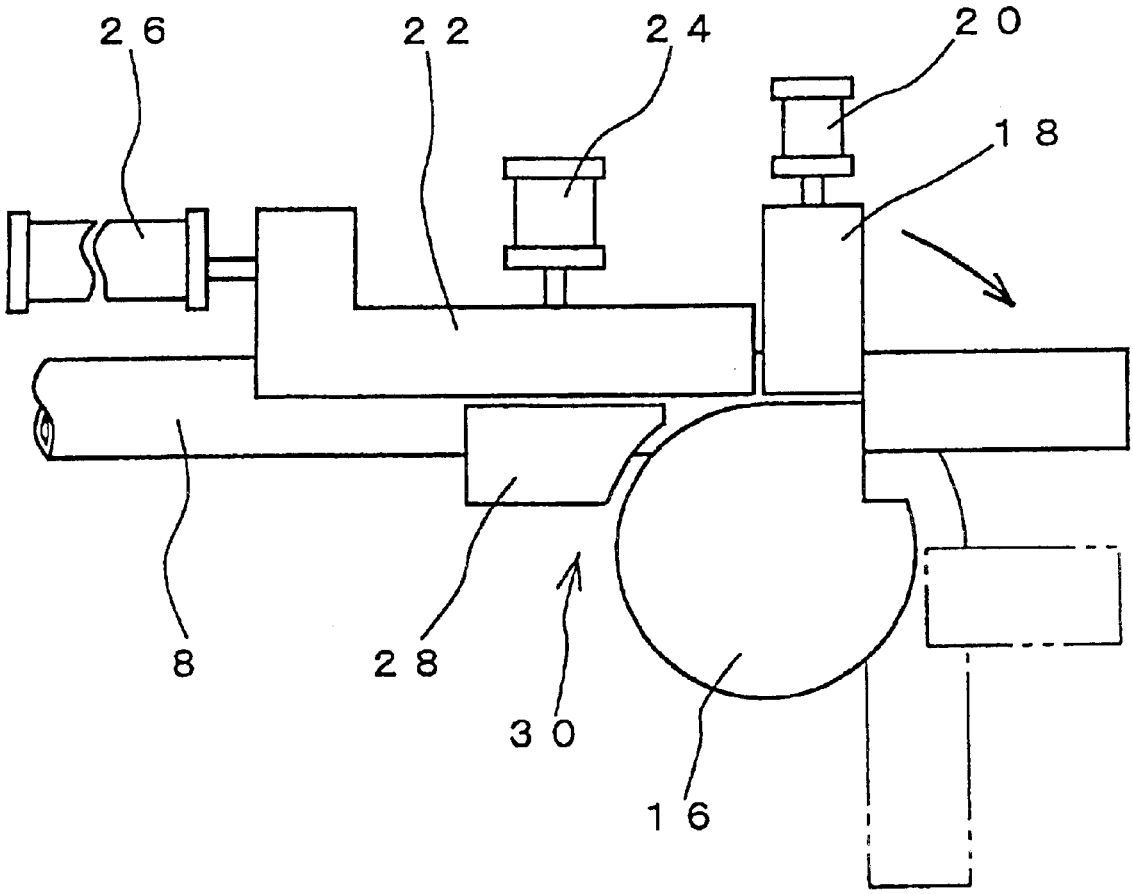
FIG. 2 is a plane view of a bending mechanism of the embodiment.

The position sensor 82 detects a moving position of the feeding table 6 (material 8). As shown in FIG. 2, when the material 8 is provided between the bending die 16 and the clamping die 18 and this material reaches the first bending position (Step 130: YES), the servo valve 56 is switched to the stop position 56*b* to stop the movement of the feeding table 6 (Step 140).

Then, the drive signal is outputted to the servo valve 18*a* via the drive circuit 18*c* to drive the hydraulic cylinder 20 and hold the material 8 between the bending die 16 and the clamping die 18. Furthermore, the drive signal is outputted to the servo valve 22*a* via the drive circuit 22*c* to drive the hydraulic cylinder 24 and thrust the pressure die 22 against the material 8 (Step 150). At this point, the position sensor 18*b* detects the material 8 being held between the bending die 16 and the clamping die 18, and the position sensor 22*b* detects the pressure die 22 being thrust against the material 8.

In the next step, a point number (later explained in detail), used when the axial compressive force is applied to the material 8, is set to an initial value "1" (Step 160).

Each valve in the hydraulic circuit 50 is then set to a pressure control channel position (Step 170). More particularly, the first switching valve 62 is switched to the pressure control position 62*c* in accordance with the drive signal outputted via the drive circuit 63*a*, and the second switching valve 64 is switched to the pressure control position 64*c* in accordance with the drive signal outputted via the drive circuit 65*a*.

The electric motor 74 is driven under a predetermined condition to discharge the operating oil from the hydraulic pump 69, and thus compressive force for preliminary pressurization, which is the axial compressive force, is applied to the material 8 (Step 180).

More particularly, the operating oil discharged from the hydraulic pump 69 in such a way is supplied to the hydraulic motor 36 from the supply/discharge port "a" via the supply channel 70, the first switching valve 62, the first pressure control channel 66 and the first supply/discharge channel 53. The operating oil from the hydraulic motor 36 is returned to the hydraulic tank 71 via the supply/discharge port "b", the second supply/discharge channel 55, the second pressure control channel 68, the second switching channel 64 and the return channel 72.

The hydraulic motor 36 is spun by the supply of the operating oil as above. As a result, the feeding table 6 is driven toward the bending mechanism 30. At this point, since the material 8 is held between the bending die 16 and the clamping die 18, the compressive force for preliminary pressurization, which is the axial compressive force, is applied to the material 8.

The magnitude of the compressive force for preliminary pressurization is adjusted to a predetermined value by reducing the pilot pressure of the pressure reducing valve 76 in accordance with the drive signal outputted to the operate valve 78 via the drive circuit 78*a* and controlling the pressure of the high pressure operating oil supplied to the hydraulic motor 36.

In other words, if a fluid path including the pressure control channels 66 and 68, where the electromagnetic proportional pressure reducing valve (pressure reducing valve 76) is arranged is used for passing of the operating oil, the pilot pressure of the pressure reducing valve 76 is adjusted to a predetermined level via the operate valve 78 and it is possible to spin the hydraulic motor 36 by the high pressure operating oil under pressure (drive force) corresponding to the pilot pressure.

The compressive force for preliminary pressurization here means the axial compressive force which is applied to the material 8 before the material 8 undergoes actual bending. It is for eliminating escape of the force applied to the material 8 upon bending and insuring the desired pressure to be applied to the material 8 when the bending is started.

The compressive force for preliminary pressurization is continually applied to the material 8, until the escape of the aforementioned force is eliminated and the pressure detected by the load cell 80 reaches to a predetermined value (Steps 180–190). When the pressure reaches to the predetermined value (Step 190: YES), the bending is started (Step 200).

In Step 200, a drive signal is outputted to the servo valve 16*a* via the drive circuit 16*c* to drive a hydraulic cylinder (not shown). As a result, as shown in FIG. 2, the bending die 16 and the clamping die 18 start to rotate on the axis of the bending die 16. Rotation angle positions made thereby are sequentially detected by the position sensor 16*b*.

At the same time, a drive signal is outputted to the servo valve 22*d* via the drive circuit 22*f* to drive the hydraulic cylinder 26. As a result, the pressure die 22 starts to move toward the axial direction of the material 8 based on the progress of the bending of the material 8. As such, in the present embodiment, the axial compressive force is applied to the material 8 also by moving the pressure die 22 along the axial direction of the material 8 while the pressure die 22 is thrust against the material 8. This movement of the pressure die 22 by the hydraulic cylinder 26 may be performed as required.

Also in Step 200, when the material 8 is drawn to the axial direction thereof, accompanied by the rotation of the bending die 16, the axial compressive force detected by the load cell 80 is controlled to have the magnitude according to the aforementioned point number.

In short, in the present embodiment, the axial compressive force applied to the material 8 is varied according to the bending angles of the material 8. The axial compressive force corresponding to each of the bending angles is stored in the ROM 94, along with a range of the bending angle in which the compressive force is applied, in association with a plurality of point numbers (which are from 1 to 5 in the present embodiment) (see FIG. 6).

In the chart of FIG. 6, if the point number is the initial value "1", the axial compressive force having the magnitude according to this point number shown in FIG. 6 is applied to the material 8.

In order to control this axial compressive force, pressure of the high pressure operating oil, supplied to the hydraulic motor 36 and flowing through the hydraulic circuit 50 which is set to the pressure control channel position, is adjusted to correspond to the pilot pressure of the pressure reducing valve 76 by controlling the pilot pressure as in the case of applying the aforementioned compressive force for preliminary pressurization. When the hydraulic motor 36 is driven by the high pressure operating oil, of which pressure (drive force) is adjusted as such, the sprocket 38 is rotated with large torque corresponding to this pressure (drive force). The large axial compressive force corresponding to this pressure (drive force) is applied to the material via the feeding table 6 and the chuck mechanism 10. Meanwhile, the magnitude of the compressive force is maintained within the range according to the point number.

The axial compressive force corresponding to a point number is continually applied until the bending angle of the material 8, obtained from the output of the position sensor 16*b*, reaches the maximum bending angle corresponding to the point number (Step 210).

When the bending angle of the material 8 reaches the maximum bending angle in the point number (Step 210: YES), it is determined, on the basis of the output of the position sensor 16*b*, whether the feeding table 6 is moved toward the bending mechanism 30 by a predetermined bending arc length. The bending arc length here means a moving distance of the feeding table 6 by the time the bending of the material 8 at a specified point is completed. It is calculated from a formula using the bending radius and the bending angle.

If the bending of the material 8 is not yet completed and the moving distance of the feeding table 6 also does not reach the bending arc length, Step 220 is negatively determined (Step 220: NO). The point number is incremented by 1 (Step 230) and the process from Steps 200 to 220 is performed again.

By repetition of the process from Steps 200 to 230, the axial compressive force according to the point number 1 through the maximum is respectively applied to the material 8 within the range of the bending angle corresponding to the axial compressive force. When the clamping die 18 is rotated around the bending die 16 till a predetermined angle is obtained and the moving distance of the feeding table 6 reaches the bending arc length (Step 220: YES), application of the axial compressive force to the material 8 is stopped and so is the bending (Step 240).

More particularly, the first switching valve 62 and the second switching valve 64 are respectively switched to the stop positions 62*b* and 64*b* to stop the drive of the hydraulic motor 36. Moreover, rotation of the clamping die 18 and the bending die 16 is stopped and movement of the pressure die 22 is also stopped.

Next, the clamping die 18 and the bending die 16 release the material 8, and the pressure die 22 moves away from the material 8. Then, the clamping die 18, the bending die 16 and the pressure die 22 are returned to their original position before the bending shown in FIG. 2 (Step 250).

In the next step, it is determined whether the bending currently made to the material 8 is the final bending, that is, whether the predetermined conditions are satisfied (Step 260).

If the bending is not completely finished, that is, if bending at other locations of the material 8 is to be conducted (Step 260: NO), the process is returned to Step 110, and Steps 110 to 260 are repeated. In these steps, if the bending direction of the material 8 is different from that of the previous bend, the motor 12 is driven by means of the drive signal outputted via the drive circuit 10*b* in Step 120, and the chuck mechanism 10 is rotated by the predetermined angle to twist the material 8.

On the contrary, if it is determined that the bending of the material is complete (Step 260: YES), the chuck mechanism 10 is loosened to release the material 8 (Step 270). The first switching valve 62 and the second switching valve 64 are then respectively switched to the speed control positions 62*a* and 64*a*, and the servo valve 56 is switched to the back position 56*c* to set respective valves in the hydraulic circuit 50 to the speed control channel position. Then the hydraulic pump 69 is driven to return the feeding table 6 to its original position before the bending (Step 280), to end the present control process.

As described above, because the channel in the bending device is selectively switched to the speed control channel and the pressure control channel, the device, although it is small, can control the feeding speed of the material 8 and also apply the axial compressive force to the material 8. If the hydraulic pump 69 serves as the hydraulic source varying its discharge rate, it can control the speed and application of the axial compressive force which can be advantageous. Moreover, in the present embodiment, since the axial compressive force is applied to the material 8 when the material 8 is bent, it is possible to prevent the radial thickness of the material 8. Also, since the axial compressive force of the material 8 can be varied according to the bending angle of the material 8, it is possible to effectively prevent buckling of the material 8 while the desired bent form is obtained.

The present invention is not limited to the above embodiment, and other modifications and variations are possible within the scope of the present invention.

What is claimed is:

1. A bending device having a feeding table supporting a chuck mechanism, the chuck mechanism facilitates gripping a material as the feeding table feeds the material to facilitate bending of the material, the bending device comprising:

a hydraulic source;

a hydraulic actuator driveably coupled to the feeding table to facilitate movement thereof; and a hydraulic circuit which can be selectively switched between a speed control channel and a pressure control channel, the speed control channel supplies operating oil from the hydraulic source to the hydraulic actuator while controlling a flow of the operating oil, and the pressure control channel supplies the operating oil from the hydraulic source to the hydraulic actuator while controlling a pressure of the operating oil.

2. The bending device set forth in claim 1, wherein the hydraulic source is a hydraulic pump which varies a discharge rate of the operating oil.

3. The bending device set forth in claim 1, wherein the hydraulic actuator is a hydraulic motor.

4. The bending device set forth in claim 1, wherein the speed control channel includes a servo valve.

5. The bending device set forth in claim 1, wherein the pressure control channel includes a pressure reducing valve.

6. The bending device set forth in claim 1, wherein a pressure of the operating oil in the pressure control channel is controlled in accordance with a bending angle of the material to be bent so that an axial compressive force applied to the material can be varied.

* * * * *